US007500594B1

(12) United States Patent
Toth et al.

(10) Patent No.: US 7,500,594 B1
(45) Date of Patent: Mar. 10, 2009

(54) CARTON AND BLANK FOR PRODUCING A CARTON

(75) Inventors: Zsolt Toth, Tuckahoe, NY (US); David Christopher DeMent, Granville, OH (US)

(73) Assignee: Zsolt Toth, Tuckahoe, NY (US)

( * ) Notice: Subject to any disclaimer, the term of this patent is extended or adjusted under 35 U.S.C. 154(b) by 0 days.

(21) Appl. No.: 12/036,492

(22) Filed: Feb. 25, 2008

(51) Int. Cl.
*B65D 5/08* (2006.01)

(52) U.S. Cl. ..... 229/137; 229/138; 229/184; 229/931

(58) Field of Classification Search ..... 229/137, 229/138, 139, 184, 125.42, 930, 931
See application file for complete search history.

(56) References Cited

U.S. PATENT DOCUMENTS

| | | | | |
|---|---|---|---|---|
| 327,224 | A | 9/1885 | Betts | |
| 630,789 | A | 8/1899 | Wyman | |
| 671,759 | A | 4/1901 | Craw | |
| 681,322 | A | 8/1901 | Houghland | |
| 915,579 | A | 3/1909 | Ferres | |
| 916,544 | A | 3/1909 | Ferres | |
| 1,587,038 | A | 6/1926 | Sandor | |
| 1,772,106 | A | 8/1930 | Miller | |
| 1,896,721 | A | 2/1933 | Richards | |
| 1,930,348 | A | 10/1933 | Parrott | |
| 2,034,594 | A | 3/1936 | Norris et al. | |
| 2,037,428 | A | 4/1936 | Newsom | |
| 2,070,747 | A | 2/1937 | Orstrom | |
| 2,134,130 | A | 10/1938 | Hughes | |
| 2,178,091 | A | 10/1939 | Weiss | |
| 2,232,088 | A | 2/1941 | Waters | |
| 2,336,763 | A | 12/1943 | Wilcox | |
| 2,357,535 | A | 9/1944 | Monroe | |
| 2,390,909 | A | 12/1945 | Zinn, Jr. | |
| 2,439,435 | A | 4/1948 | Richardson et al. | |
| 2,439,735 | A | 4/1948 | Homrighous | |
| 2,521,989 | A | 9/1950 | MePherson | |
| 2,736,998 | A | 3/1956 | Walrave et al. | |
| 2,799,442 | A | 7/1957 | Van Rosen | |
| 2,810,506 | A | 10/1957 | Kessler | |
| 2,874,891 | A | 2/1959 | Kelsall | |
| 2,926,777 | A | 3/1960 | Maguire | |
| 4,063,679 | A * | 12/1977 | Henry | 229/138 |
| 4,819,861 | A * | 4/1989 | Nagata | 229/930 |
| 4,858,822 | A * | 8/1989 | Johnson et al. | 229/137 |
| 5,971,266 | A * | 10/1999 | Sampaolo et al. | 229/137 |
| 6,467,682 | B2 | 10/2002 | Toth et al. | |

(Continued)

*Primary Examiner*—Gary E Elkins
(74) *Attorney, Agent, or Firm*—Antonelli, Terry, Stout & Kraus, LLP.

(57) ABSTRACT

A blank for producing a carton and a carton erected from the blank wherein two 180° fold lines of each fold-in panel in the blank and carton extend from a point on a second end edge of such panel substantially midway between first and second side edges thereof to respective ones of points of the intersections of a first end edge thereof and first and second side edges thereof. Each of these two 180° fold lines of the fold-in panels includes first and second compressed areas extending from respective ends of the 180° fold line, and a C-shaped cut extending between the first and second compressed areas. The fold-in panels form part of continuous closure panels of the carton erected from the blank and enable the continuous closure panels to snap shut upon closure and remain closed in a closed position.

24 Claims, 7 Drawing Sheets

U.S. PATENT DOCUMENTS 6,668,525 B2 12/2003 Toth et al.
6,886,311 B2 5/2005 Toth et al.
6,951,530 B2 10/2005 Toth et al.

* cited by examiner

CARTON AND BLANK FOR PRODUCING A CARTON

TECHNICAL FIELD

The present invention is directed to an improved blank for producing a carton, and a carton erected therefrom. The invention is particularly suited for, but not limited to, corrugated blanks and cartons. Thus, while the following description and drawings make reference to corrugate blanks and cartons, the invention is applicable to blanks and cartons of other materials.

BACKGROUND

U.S. Pat. Nos. 6,467,682; 6,668,525; 6,886,311 and 6,951,530 disclose a carton, a blank for producing a carton, and methods and apparatus for erecting, closing and sealing a carton. The blank for erecting a carton has fold-in panels that include 180° fold lines with a compressed area at each end and a straight slit joining the compressed areas. A carton is erected by moving the blank in a first direction against a stop to form a first set of 90° folds, holding the blank stationary with a suction while pushing the blank in a second direction to form a second set of 90° folds, erecting the carton. A filled carton is closed by advancing it through the central opening of a V-shaped member to increasingly fold the continuous closure panel formed by the carton top panels. The closed carton is sealed by advancing it through a second V-shaped member and into contact with a pivotally supported sealing device. The disclosures of the aforementioned U.S. patents are hereby incorporated by reference.

An example of this known carton blank 30 from which a carton can be erected is shown in FIG. 1. Blank 30 includes a first side panel 32 having a first end edge 34, a second end edge 36, a top edge 38 and a bottom edge 40. End edges 34 and 36 are substantially parallel with each other, while top edge 38 and bottom edge 40 are substantially parallel with each other and substantially perpendicular to edges 34 and 36. Blank 30 further includes a first end panel 42 having a first side edge 44, a second side edge 46, a top edge 48, and a bottom edge 50. Carton blank 30 also includes a second side panel 52 having a first end edge 54, a second end edge 56, a top edge 58, and a bottom edge 60. Carton 30 further includes a second end panel 62 having a first side edge 64, a second side edge 66, a top edge 68, and a bottom edge 70. Edges 46, 54, 56, 64 and 66 are substantially parallel with edge 34, while edges 48, 58, and 68 are extensions of edge 38, and edges 50, 60, and 70 are extensions of edge 40.

Carton blank 30 also includes a first top panel 72 having a first side edge 74, a second side edge 76, a first end edge 78, and a second end edge 80. Edges 74 and 76 are substantially parallel with edge 38, and edges 78 and 80 are extensions of edges 34 and 36, respectively. Carton blank 30 includes a first bottom panel 82 having a first side edge 84, a second side edge 86, a first end edge 88, and a second end edge 90. Edges 84 and 86 are substantially parallel with edge 38, while edges 88 and 90 are extensions of edges 34 and 36, respectively. Carton blank 30 also includes a first fold-in panel 92 having a first end edge 94, a second end edge 96, a first side edge 98, and a second side edge 100. Edges 94 and 96 are extensions of edges 74 and 76, respectively, while edges 98 and 100 are extensions of edges 44 and 46, respectively. Carton blank 30 has a second fold-in panel 102 having a first end edge 104, a second end edge 106, a first side edge 108, and a second side edge 110. Edges 104 and 106 are extensions of edges 84 and 86 respectively, while edges 108 and 110 are extensions of edges 44 and 46, respectively. Carton blank 30 includes a second top panel 112 having a first side edge 114, a second side edge 116, a first end edge 118, and a second end edge 120. Edges 114 and 116 are extensions of edges 94 and 96, respectively, while edges 118 and 120 are extensions of edges 54 and 56, respectively. Carton blank 30 includes a second bottom panel 122 having a first side edge 124, a second side edge 126, a first end edge 128, and a second end edge 130. Edges 124 and 126 are extensions of edges 104 and 106, respectively, while edges 128 and 130 are extensions of edges 54 and 56, respectively. Carton blank 30 additionally includes a third fold-in panel 132 having a first end edge 134, a second end edge 136, a first side edge 138, and a second side edge 140. Edges 134 and 136 are extensions of edges 114 and 116, respectively, while edges 138 and 140 are extensions of edges 64 and 66, respectively. Carton blank 30 includes a fourth fold-in panel 142 having a first end edge 144, a second end edge 146, a first side edge 148 and a second side edge 150. Edges 144 and 146 are extensions of edges 124 and 126, respectively, while edges 148 and 150 are extensions of edges 64 and 66, respectively.

First end panel 42 extends from first side panel 32, with first side edge 44 of first end panel 42 joined to second side edge 36 of first side panel 32 to define a 90° fold line. Second side panel 52 extends from first end panel 42, with first end edge 54 joined to second side edge 46 to define a 180° fold line. Second end panel 62 extends from second side panel 52, with first side edge 64 joined to second end edge 56 to define a 90° fold line. First top panel 72 extends from first side panel 32, with first side edge 74 joined to top edge 38 to define a 90° fold line. First bottom panel 82 extends from first side panel 32, with first side edge 84 joined to bottom edge 40 to define a 90° fold line. First fold-in panel 92 extends from first end panel 42, with first end edge 94 joined to top edge 48 to define a 90° fold line and with first side edge 98 joined to second end edge 80 to define a 180° fold line. Second fold-in panel 102 extends from first end panel 42, with first end edge 104 joined to bottom edge 50 to define a 90° fold line and with first side edge 108 joined to second end edge 90 to define a 180° fold line. Second top panel 112 extends from second side panel 52, with first side edge 114 joined to top edge 58 to define a 90° fold line and with first end edge 118 joined to second side edge 100 of first fold-in panel 92 to define a 180° fold line. Second bottom panel 122 extends from second side panel 52, with first side edge 124 joined to bottom edge 60 to define a 90° fold line and with first end edge 128 joined to second side edge 110 of second fold-in panel 102 to define a 180° fold line. Third fold-in panel 132 extends from second end panel 62, with first end edge 134 joined to top edge 68 to define a 90° fold line and with first side edge 138 joined to second end edge 120 of top panel 112 to define a 180° fold line. Fourth fold-in panel 142 extends from second end panel 62, with first end edge 144 joined to bottom edge 70 to define a 90° fold line and with first side edge 148 joined to second end edge 130 of bottom panel 122 to define a 180° fold line.

Each fold-in panel 92, 102, 132, and 142 includes a pair of 180° fold lines 152 which extend from a point on the second end edge 96, 106, 136, 146, of the respective panel substantially midway between the first and second side edges of such panel to respective ones of points at the intersections of the first end edge 94, 104, 134, 144 of the respective panel and the first and second side edges of such panel. The carton blank 30 in the example also includes a sealing strip 154 extending from third fold-in panel 132, second end panel 62, and fourth fold-in panel 142 as depicted in FIG. 1. Sealing strip 154 includes fold lines which are extensions of the 90° fold lines defined by edges 68 and 134 and edges 70 and 144. After carton blank 30 has been manufactured, it is folded 180° on the fold line defined by edges 46, 54, 100, 110, 118, and 128, and sealing strip 154 is sealed to panels 72, 32, and 82, forming the folded carton blank as depicted in FIG. 15 of the aforementioned U.S. patents. Alternatively, sealing strip 154 can be omitted, and panels 132, 62, and 142 sealed to panels 72, 32, and 82 by other means such as a sealing tape. Further, instead of making the folded carton blank in one piece, it can be made in two pieces which are then sealed together, as discussed below with regard to FIG. 11.

FIGS. 2-5 show the form of the 180° fold lines of the known carton blank. Each 180° fold line includes first and second compressed areas 156 which extend from opposite ends of the 180° fold line for a distance of about two inches and which are joined by a straight slit 158. Each compressed area 156 is preferably oval in shape with a maximum width of from about ⅜ inch to about ½ inch for standard packing carton corrugated panels. As can be seen in FIG. 3, each compressed area 156 extends into the material of carton blank 30 a substantial distance, while leaving the adjacent panel portions joined. A protrusion 160 extends from the undersurface of carton blank 30, substantially along the center line of each compressed area 156 to define a fold line. As can be seen in FIG. 4, each slit 158 extends through carton blank 30.

FIG. 5 illustrates the manner in which carton blank 30 can be folded 180° as a result of the 180° fold lines formed by compressed areas 156 and slits 158. As can be seen in FIG. 5, as a result of compressed areas 156, the 180° fold is readily made without unduly stressing the carton blank material.

FIGS. 6-10 illustrate the manner in which a carton 162 formed from carton blank 30 can be closed after the carton has been erected and filled. In FIG. 6, carton 162 is illustrated with top panels 72 and 112 and first and second fold-in panels 92 and 132 extending upwardly from their corresponding side panels and end panels together forming a continuous closure panel. FIG. 7 illustrates carton 162 when fold-in panels 92 and 132 are initially folded in on 180° fold lines 152. Top panels 72 and 112 are folded partially together. FIG. 8 depicts carton 162 with the fold-in panels 92 and 132 further folded in and with top panels 72 and 112 folded closer together. FIG. 9 illustrates carton 162 full closed. FIG. 10 shows the closed carton 162 with top panels 72 and 112 sealed together, by a sealing tape 164. Carton 162 can be closed and sealed with the method and apparatus disclosed in the aforementioned U.S. patents or, if desired, carton 162 can be closed and sealed, as well as erected, manually. Manual erecting and closing of carton 162 can be done rapidly by simply pressing on any one of the bottom panels to erect the carton and any one of the top panels to close the carton. Pressing on any one of the bottom panels or of the top panels causes all of the bottom panels or the top panels to fold inwardly, closing the bottom or the top.

Instead of the single piece carton blank 30 of FIG. 1, the carton blank can be formed of two blanks 169 as illustrated in FIG. 11. The two blanks 169 are then positioned one over the other, with one rotated 180° with respect to the other, and the sealing strip of each blank is sealed to the other blank. This construction provides a carton blank 30 just as illustrated in FIG. 15 of the aforesaid U.S. patents.

FIG. 12 depicts another form of carton **162*b* having a strip 212 of sealing tape affixed to top panel 112 so that when top panels 72 and 112 are closed, the strip will adhere to panel 72**, sealing the carton. With this feature, a sealing apparatus is not necessary.

It has been found that the top and bottom panels of cartons erected from these known carton blanks, when closed, have a tendency to spring open from their closed position. There is a need for an improved carton of the above-described type, and an improved carton blank for erecting the carton, which avoids this drawback of the known carton blank and carton.

SUMMARY

The present invention addresses the aforementioned need by providing an improved blank of the type described for producing a carton wherein the top and bottom panels of the carton forming the continuous closure panels snap shut upon closing and remain in a closed position after each closure panel is pressed closed. This advantage of the invention is attained by the improved blank of the invention for producing a carton according to the present invention in which each fold-in panel has two 180° fold lines each extending from a point on the second end edge of such panel substantially midway between the first and second side edges thereof to respective ones of points at the intersections of the first end edge thereof and the first and second side edges thereof, wherein each of the two 180° fold lines of the fold-in panels includes a first compressed area extending from a first end of the 180° fold line, a second compressed area extending from a second end of the 180° fold line, and a C-shaped cut extending between the first and second compressed areas. It has been found that with fold-in panels constructed in this manner, a continuous closure panel of the carton, erected from the blank of the invention, upon being pressed toward its closed position will pull itself to its fully closed condition without need of further external pressure, and once in its fully closed condition, the closure panel is held in its fully closed condition.

The blank for producing a carton according to a disclosed, example embodiment employing a C-shaped cut in each of the aforesaid two 180° fold lines of the fold-in panels has C-shaped cuts that each include a straight cut joining the associated first and second compressed areas of the 180° fold line and first and second end cuts extending transverse to the straight cut at respective ends of the straight cut. The end cuts are perpendicular to their associated straight cut in the example embodiment. The end cuts extend from their associated straight cut toward the adjacent side edge of their fold-in panel.

According to a further feature of the blank of the example embodiment, the second edge of each fold-in panel of the blank includes a notch substantially midway between the first and second side edges of the fold-in panel. The aforesaid two 180° fold lines of each fold-in panel extend from spaced locations at the notch. The notches are trapezoidal shaped in the example embodiment. The two 180° fold lines extend from respective corners of the trapezoidal-shaped notch. This construction has been found to permit the closure panel to fold freely on top of itself to its fully closed condition without need of further external pressure and, once in its fully closed condition, the closure panel remains in the fully closed condition.

These and other features and advantages of the present invention will become more apparent from the following detailed description and claims, particularly when considered in conjunction with the accompanying drawings in which like parts bear like reference numerals.

DETAILED DESCRIPTION

Figure 1:
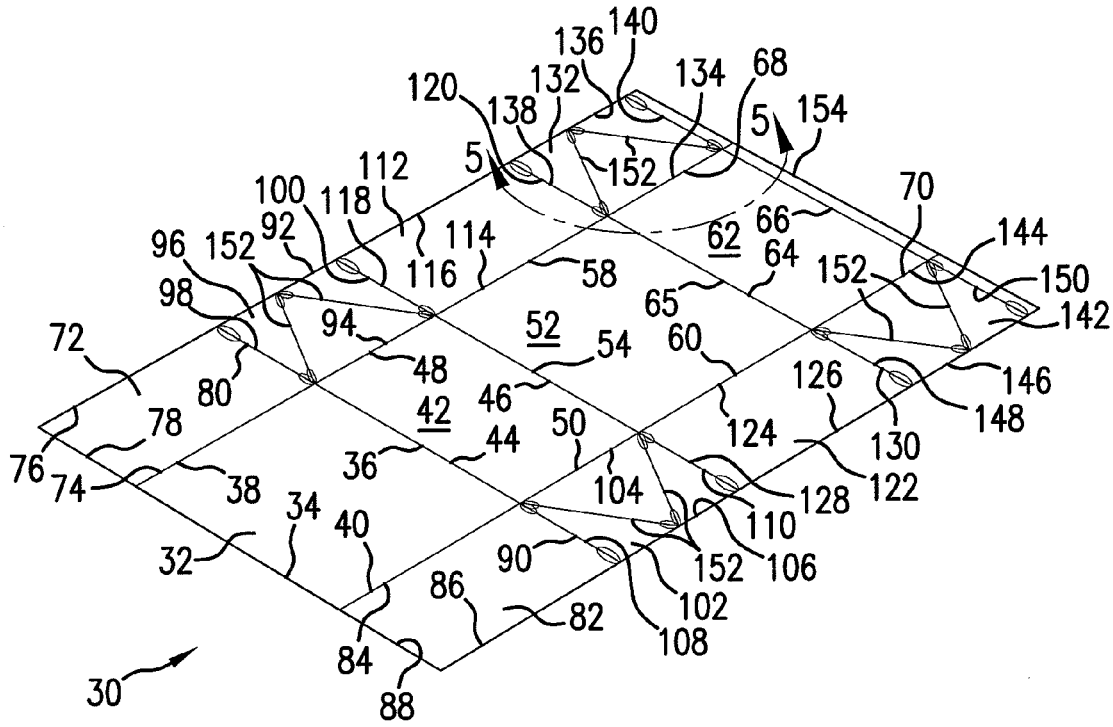
FIG. 1 PRIOR ART
FIG. 1 depicts a prior art carton blank as disclosed in the aforementioned U.S. patents.
Figure 2:
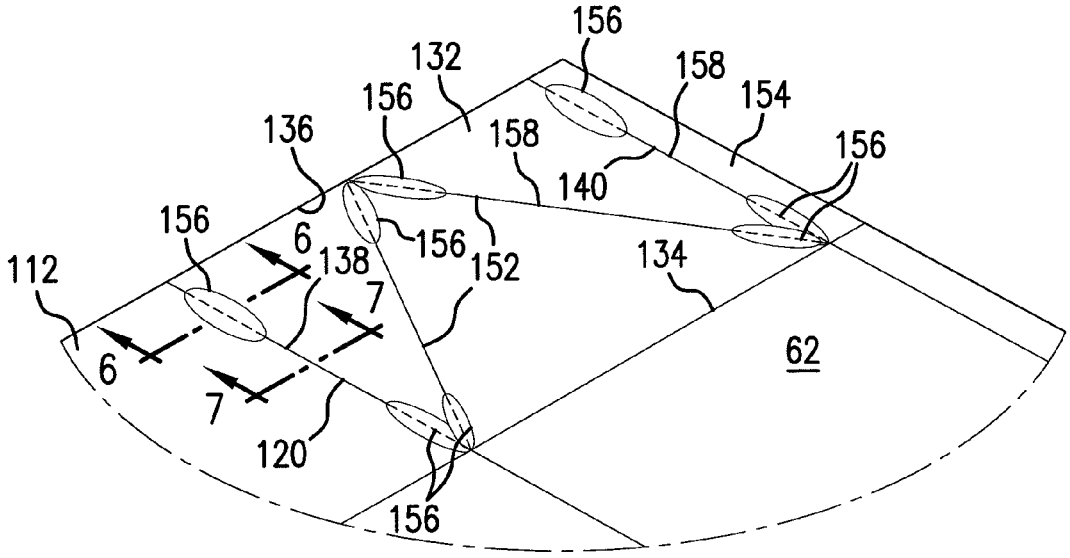
FIG. 2 PRIOR ART
FIG. 2 is an enlarged fragmentary view of area 5-5 of FIG. 1.
Figure 13:
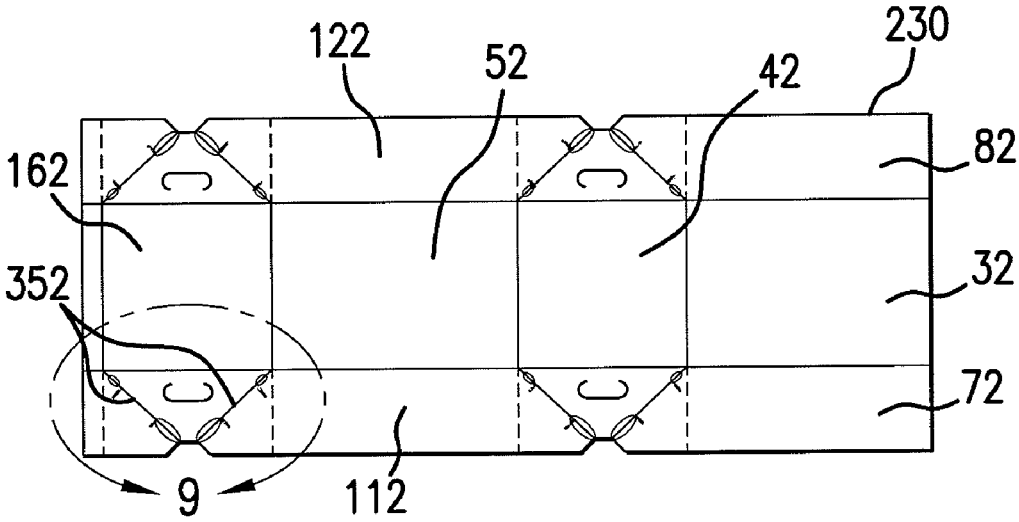
FIG. 13 is a top view of carton blank in accordance with the present invention.
Figure 16:
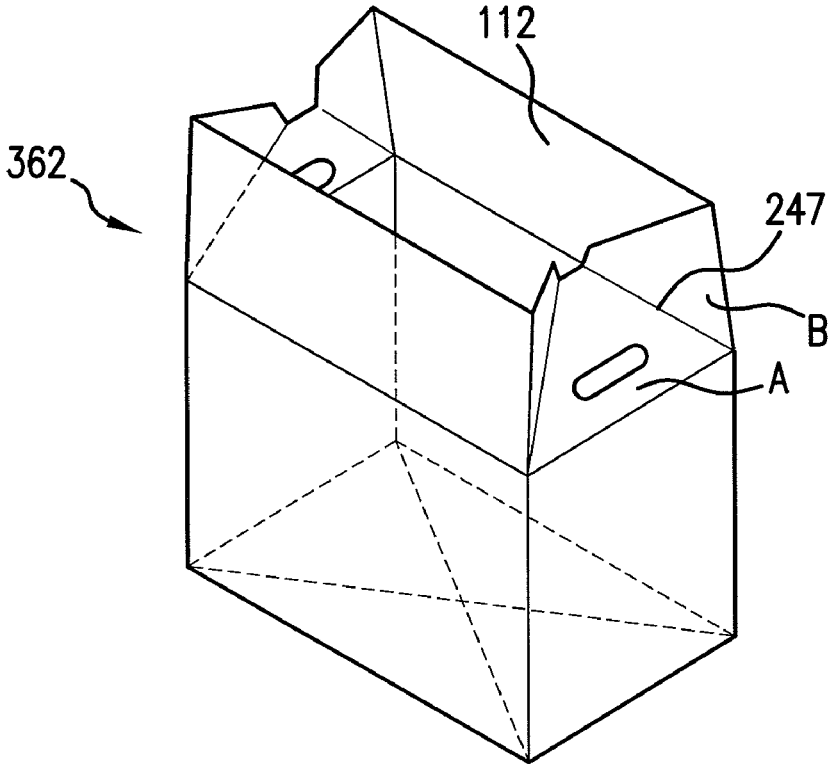
FIG. 16 is a perspective view from a side and above of an erected, partially closed carton erected using the carton blank of FIGS. 13-15.

Referring now to the drawings, the improved blank of the invention is shown at 230 in FIG. 13. The carton 362 erected from the blank 230 is shown in FIG. 16. The blank 230 is formed with first and second side panels 32 and 52, first and second end panels 42 and 62, first and second top panels 72 and 112, first and second bottom panels 82 and 122, and first, second, third and fourth fold-in panels 239-242. The various side, end, top and bottom panels have edges and 90° fold lines therebetween as described above in connection with the blank 30 in FIG. 1 and details thereof set forth above are not repeated here but are incorporated by reference from the aforementioned U.S. patents. However, the construction of the first, second, third and fourth fold-in panels 239-242 of the blank 230 differs from the known blank and carton.

Figure 3:
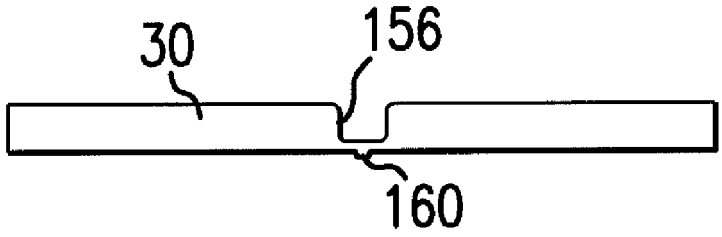
FIG. 3 PRIOR ART
FIG. 3 is a sectional view taken on line 6-6 of FIG. 2.
Figure 4:
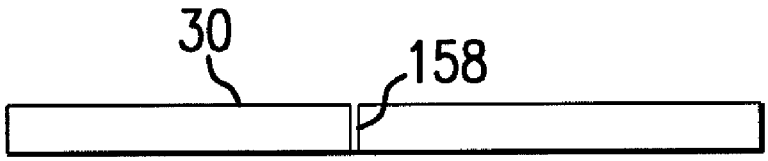
FIG. 4 PRIOR ART
FIG. 4 is a sectional view taken on line 7-7 of FIG. 2.
Figure 5:
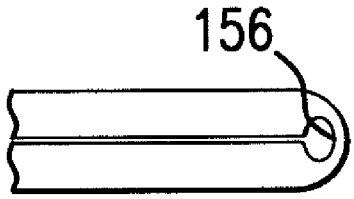
FIG. 5 PRIOR ART
FIG. 5 is a fragmentary view of a 180° fold as made in a prior art carton blank of the aforementioned; U.S. patents.
Figure 6:
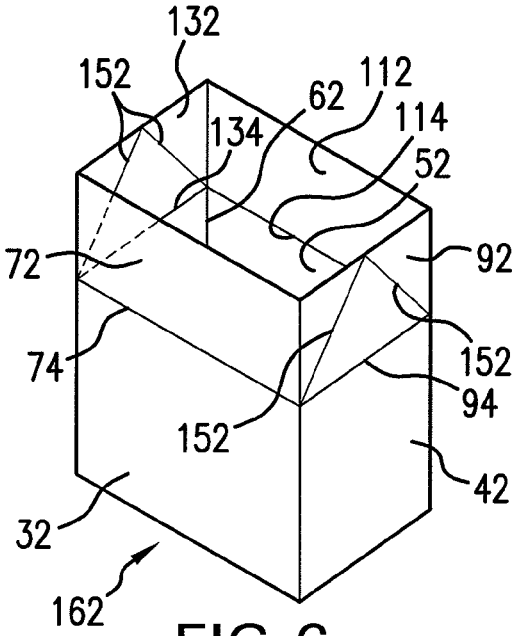
FIG.6 PRIOR ART
FIGS. 6-10 depict a prior art carton of FIGS. 1-5 in various degrees of closing.
Figure 7:
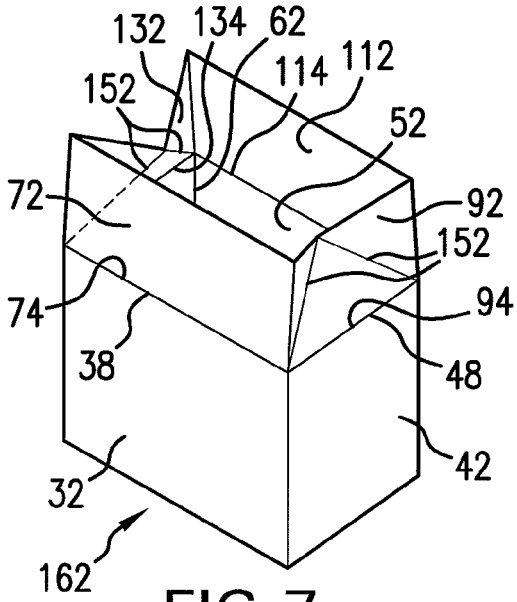
FIG.7 PRIOR ART
Figure 8:
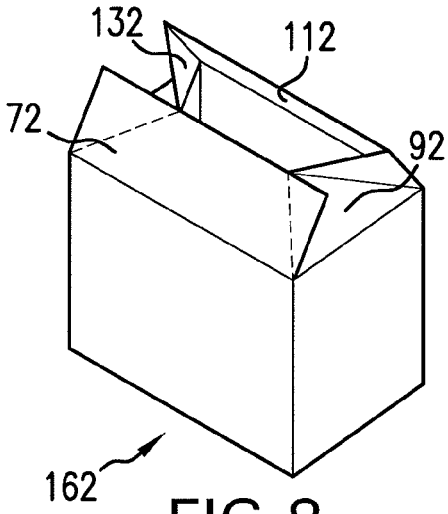
FIG.8 PRIOR ART
Figure 9:
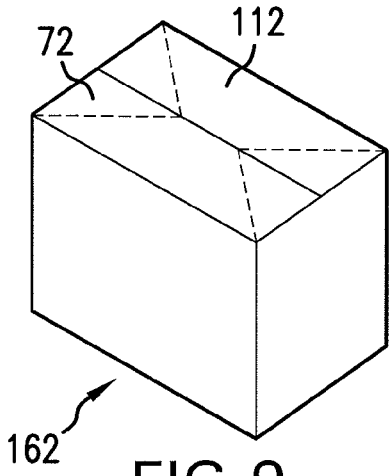
FIG.9 PRIOR ART
Figure 10:
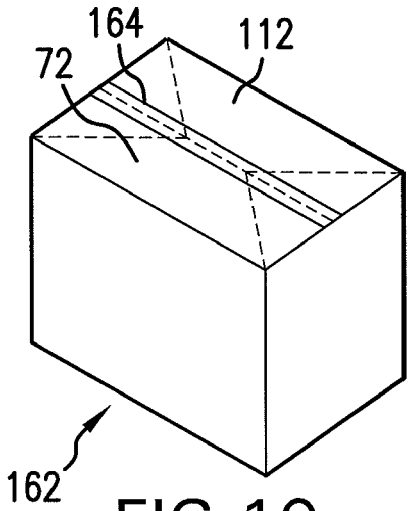
FIG.10 PRIOR ART
Figure 11:
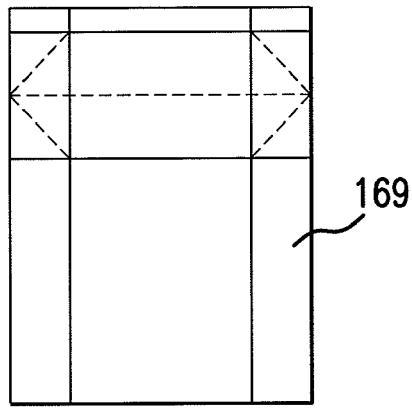
FIG.11 PRIOR ART
FIG. 11 depicts another known carton blank in accordance with the aforementioned U.S. patents.
Figure 12:
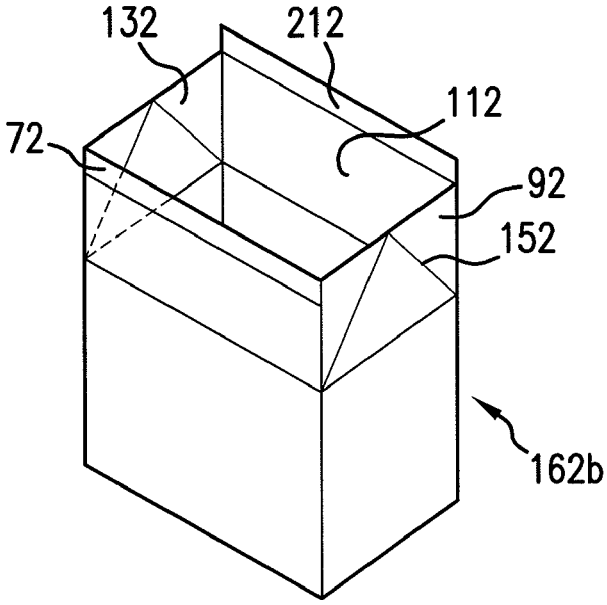
FIG.12 PRIOR ART
FIG. 12 depicts an alternative form of a known carton in accordance with the aforementioned U.S. patents.
Figure 14:
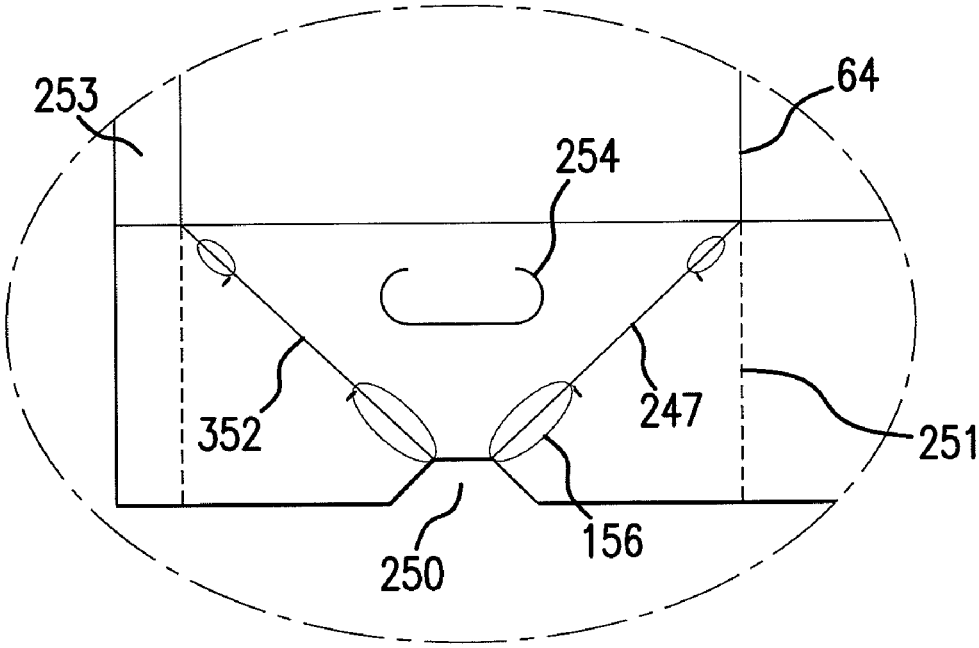
FIG. 14 is an enlarged fragmentary view of area 9-9 of FIG. 13.

Each fold-in panel 239-242 in the blank 230 has similar construction, the details of which are explained with respect to one of the fold-in panels, panel 239 in FIG. 14. As illustrated in FIG. 14, fold-in panel 239 has two 180° fold lines 352 each extending from a point on the second end edge 244 of such panel substantially midway between the first and second side edges 245 and 246 thereof to respective ones of points at the intersections of the first end edge 243 thereof and a first and second side edges thereof. Each of the two 180° fold lines 352 includes a first compressed area 156 extending from a first end of the 180° fold line, and a second compressed area 156 extending from a second end of the 180° fold line. The compressed areas 156 are like those in the known blanks and cartons described above and illustrated in FIGS. 1-12 and in the aforesaid U.S. patents. In the example embodiment, the first and second compressed areas 156 extend from opposite ends of the 180° fold line for a distance on the order of about 2 inches. Each compressed area 156 is preferably oval in shape with a maximum width on the order of from about ⅜ inch to about ½ inch for standard packing carton corrugated panels. As can be seen in FIG. 3 in connection with the explanation of the known blank 30, each compressed area 156 extends into the material of the carton blank a substantial distance, while leaving the adjacent panel portions joined. Preferably, a protrusion 160 extends from the undersurface of the carton blank, substantially along the center line of each compressed area 156 to define a fold line.

Figure 15:
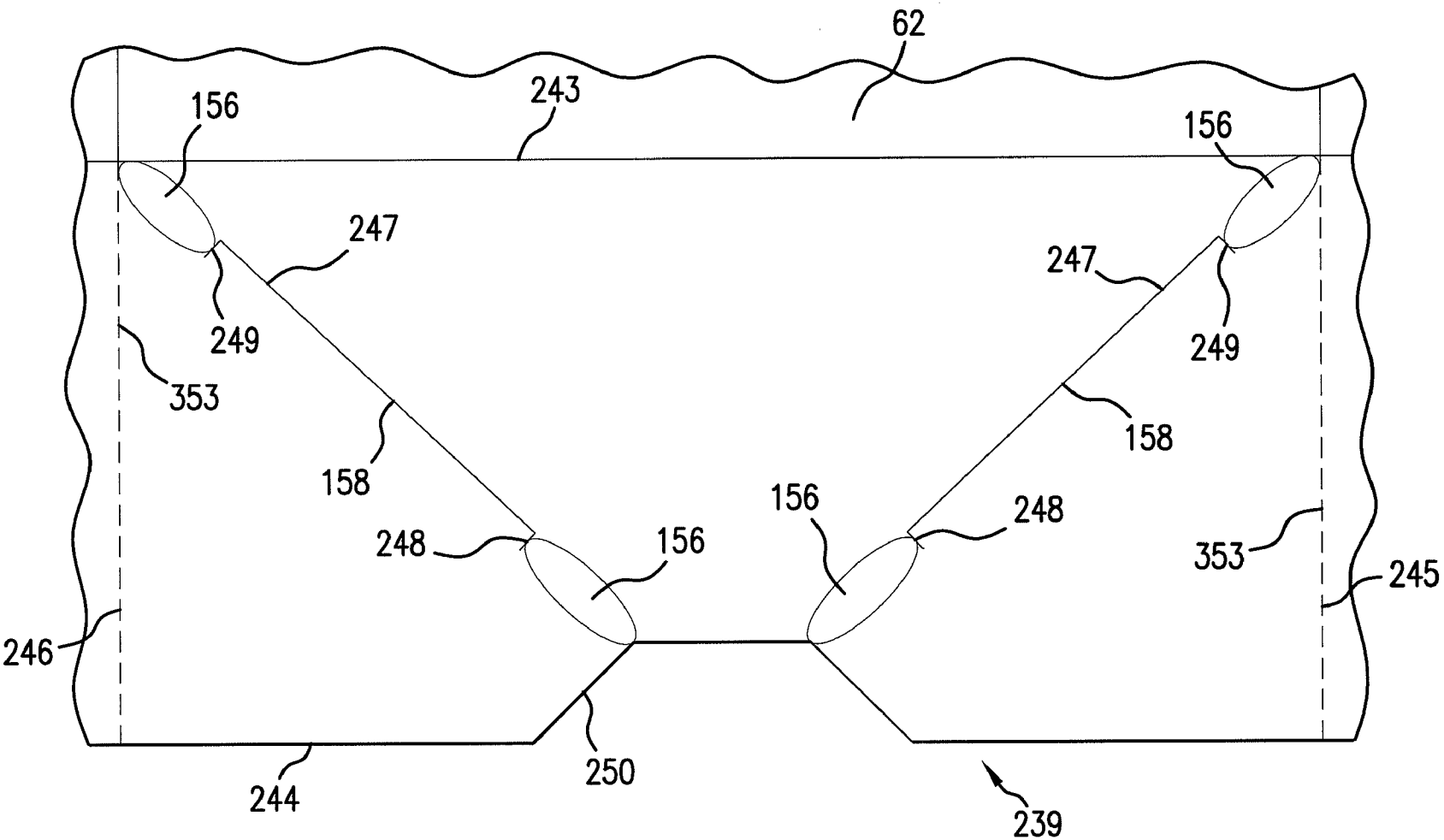
FIG. 15 is a still further enlarged fragmentary view of a portion of the carton blank shown in FIG. 14 showing the C-shaped cut extending between the first and second compressed areas of each of two 180° fold lines of the fold-in panel.

Each of the two 180° fold lines 352 of each of the fold-in panels 239-242 of the blank 230 further includes a C-shaped cut 247 extending between the first and second compressed areas. See FIGS. 14 and 15. The C-shaped cut 247 of each of the two 180° fold lines 352 of the fold-in panels 239-242 preferably extends completely through the corrugated paper material of the blank 230 and includes a straight cut in the form of a slit 158 joining the associated first and second compressed areas 156 of the 180° fold line and further includes first and second end cuts 248 and 249 extending traverse to the straight slit 158 at respective ends thereof. The end cuts 248 and 249 are each perpendicular to their associated straight cut and extend from the straight cut toward their adjacent side edge of the fold-in panel, side edges 245 and 246 in FIGS. 14 and 15. That is, each C-shaped cut 247 has the open side of its C-shape facing the adjacent side edge of the fold-in panel thereof as seen in FIGS. 14 and 15. The end cuts 248 and 249 in the example embodiment are straight cuts having a length of about ⅜ inch and like the straight cut 158 of the C-shape cut 247, the end cuts 248 and 249 are slits through the corrugated material. The end cuts 248 and 249 and cut 158 together form the C-shaped cut 247.

The second end edge 244 of each fold-in panel 239-242 of the blank 230 in the example embodiment includes a fold control notch 250 substantially midway between the first and second side edges 245 and 246 of the fold-in panel. The two 180° fold lines 352 of each fold-in panel extend from spaced locations at the notch as seen in FIGS. 14 and 15. In the example embodiment, the notches 250 are trapezoidal shaped and the two 180° fold lines 352 of each fold-in panel extend from respective corners of the trapezoidal-shaped notch thereof. The notches 250 allow the pair of 180° fold lines 352 of each fold-in panel to fold straight. The 180° fold lines 353 extending along the first and second side edges 245 and 246 of each fold-in panel 239-242 are formed by a perforated cut 251 between the fold-in panel and the adjacent panel of the blank, FIGS. 14 and 15. Like the known carton, described in connection with FIG. 9, pressing anywhere on a closure panel, such as on the top panel 252 in FIG. 16 of the carton 362 of the invention, brings the carton to its closed condition. In addition, with the C-shaped cuts 247 cut into the fold-in panels of the top and bottom closure panels, pressing anywhere on the closure panel of the carton 362 of the invention causes the closure panel to close in a single motion and, once in the closed condition, to remain in that condition.

Figure 17A:
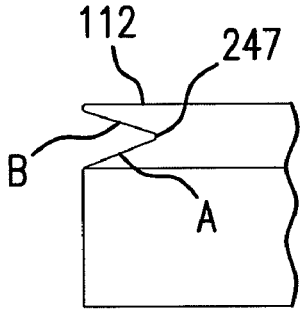
FIGS. 17A-17C are schematic illustrations of a portion of the carton of FIG. 16 as the continuous top closure panel thereof is progressively closed (FIG. 17A) to a point of equilibrium (FIG. 17B) and then to a point past equilibrium (FIG. 17C) where the fold-in panels maintain closure in accordance with the invention.
Figure 17B:
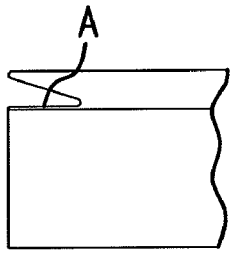
Figure 17C:
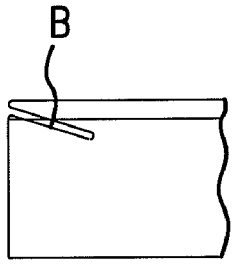

A snap closure sequence occurs during closure of the top and bottom closure panels of the carton 362 in FIG. 16. The sequence of this snap closure is illustrated in FIGS. 17A, 17B and 17C. During the initial step of the closure sequence, the closure panel, top panel 252 in FIG. 16, is pressed anywhere on the panel causing each of the two fold-in panels of the top panel to begin moving to its closed position. As indicated in FIG. 16, each fold-in panel consists of a panel portion A and two panel portions B. Continued downward pressure on the closure panel causes the two fold-in panel portions A of each fold-in panel to fold 90° with respect to their adjoining end panels 42 and 62. As 90° is close to being reached by both fold-in panel portions A as depicted in FIG. 17B, resistance from the closure panel to move to its closed condition diminishes and the closure panel begins to pull itself to its fully closed position. The ability of the closure panel, top panel 252 in the example, to pull itself to its fully closed condition after 90° is reached is because the fold-in panel portion A and fold-in panel portions B of each fold-in panel can fold freely on top of each other due to the C-shaped cuts 247 in the 180° fold lines 352 in each of the fold-in panels.

The closure panel automatically continues to pull itself to its fully closed condition, from the condition shown in FIG. 17B to the condition shown in FIG. 17C, without need of further external pressure. Once in its fully closed condition, fold-in panel portions A hold the closure panel in its fully closed condition.

The blank 230 in the example embodiment includes a sealing strip 154, FIG. 13 and FIG. 14, for sealing the blank as a carton. One hideaway handle 254 is cut into each of the four fold-in panels 239-242. When the carton is erected and the two top fold-in panels are upright, FIG. 16, the hideaway handles enable someone to easily pick up and carry the carton. When the carton is in its fully closed condition, the top and bottom fold-in panels fold over 180° and the hideaway handles are covered by the fold-in panels and thereby become hidden and inaccessible. This inaccessibility means that someone cannot reach inside the carton to access its contents, making the carton tamper resistant.

The present invention is thus seen to provide an improved carton blank that can be readily erected, closed and sealed, the closure panel of the carton remaining down in a closed position when the panel is pressed closed. The tendency to spring open from the closed position which occurs with the known carton blank and carton erected therefrom is avoided. Although the invention has been described with reference to a preferred embodiment, rearrangements, alternations, and substitutions can be made, and still the result would be within the scope of the invention. For example, the blank 169 in FIG. 11 for producing a carton when joined with a like blank as described above and in the aforementioned U.S. patents can also be provided with the fold-in panels and related features of the invention as described in connection with the embodiment of FIGS. 13-17C.

We claim:

1. A blank for producing a carton, said blank comprising:

a first side panel having substantially parallel first and second end edges and substantially parallel top and bottom edges extending substantially perpendicular to the end edges;

a first end panel having first and second side edges substantially parallel with the first side panel end edges, and having substantially parallel top and bottom edges, said first end panel extending from said first side panel with the first end panel first side edge joined to the first side panel second end edge to define a first 90° fold line and with the first end panel top and bottom edges being extensions of the first side panel top and bottom edges respectively;

a second side panel having first and second end edges substantially parallel with the first side panel end edges, and having substantially parallel top and bottom edges, said second side panel extending from said first end panel with the second side panel first end edge joined to the first end panel second side edge to define a first 180° fold line parallel with the first 90° fold line and with the second side panel top and bottom edges being extensions of the first end panel top and bottom edges respectively;

a second end panel having first and second side edges substantially parallel with the first side panel end edges, and having substantially parallel top and bottom edges, said second end panel extending from said second side panel with the second end panel first side edge joined to the second side panel second end edge to define a second 90° fold line and with the second end panel top and bottom edges being extensions of the second side panel top and bottom edges respectively;

a first top panel having first and second side edges substantially parallel with the first side panel top edge, and having substantially parallel first and second end edges, said first top panel extending from said first side panel with the first top panel first side edge joined to the first side panel top edge to define a third 90° fold line and with the first top panel first and second end edges being extensions of the first side panel first and second end edges respectively;

a first bottom panel having first and second side edges substantially parallel with the first side panel bottom edge, and having substantially parallel first and second end edges, said first bottom panel extending from said first side panel with the first bottom panel first side edge joined to the first side panel bottom edge to define a fourth 90° fold line and with the first bottom panel first and second end edges being extensions of the first side panel first and second end edges respectively;

a first fold-in panel having first and second end edges substantially parallel with the first end panel top edge, and having substantially parallel first and second side edges, said first fold-in panel extending from said first end panel with the first fold-in panel first end edge joined to the first end panel top edge to define a fifth 90° fold line, with the first fold-in panel side edges being extensions of the first end panel first and second side edges respectively, and with the first fold-in panel first side edge joined to the first top panel second end edge to define a second 180° fold line;

a second fold-in panel having first and second end edges substantially parallel with the first end panel bottom edge, and having substantially parallel first and second side edges, said second fold-in panel extending from said first end panel with the second fold-in panel first end edge joined to the first end panel bottom edge to define a sixth 90° fold line, with the second fold-in panel first and second side edges being extensions of the first end panel first and second side edges respectively, and with the second fold-in panel first side edge joined to the first bottom panel second end edge to define a third 180° fold line;

a second top panel having first and second side edges substantially parallel with the second side panel top edge, and having substantially parallel first and second end edges, said second top panel extending from said second side panel with the second top panel first side edge joined to the second side panel top edge to define a seventh 90° fold line, with the second top panel first and second end edges being extensions of the second side panel first and second end edges respectively, and with the second top panel first end edge joined to the first fold-in panel second side edge to define a fourth 180° fold line;

a second bottom panel having first and second side edges substantially parallel with the second side panel bottom edge, and having substantially parallel first and second end edges, said second bottom panel extending from said second side panel with the second bottom panel first side edge joined to the second side panel bottom edge to define an eighth 90° fold line, with the second bottom panel first and second end edges being extensions of the second side panel first and second end edges respectively, and with the second bottom panel first end edge joined to the second fold-in panel second side edge to define a fifth 180° fold line;

a third fold-in panel having first and second end edges substantially parallel with the second end panel top edge, and having substantially parallel first and second side edges, said third fold-in panel extending from said second end panel with the third fold-in panel first end edge joined to the second end panel top edge to define a ninth 90° fold line, with the third fold-in panel first and second side edges being extensions of the second end panel first and second side edges respectively, and with the third fold-in panel first side edge joined to the second top panel second end edge to define a sixth 180° fold line; and a fourth fold-in panel having first and second end edges substantially parallel with the second end panel bottom edge, and having substantially parallel first and second side edges, said fourth fold-in panel extending from said second end panel with the fourth fold-in panel first end edge joined to the second end panel bottom edge to define a tenth 90° fold line, with the fourth fold-in panel first and second side edges being extensions of the second bottom panel first and second side edges respectively, and with the fourth fold-in panel first side edge joined to the second bottom panel second end edge to define a seventh 180° fold line;

each fold-in panel having two 180° fold lines each extending from a point on the second end edge of such panel substantially midway between the first and second side edges thereof to respective ones of points at the intersections of the first end edge thereof and the first and second side edges thereof, wherein each of said two 180° fold lines of the fold-in panels includes a first compressed area extending from a first end of the 180° fold line, a second compressed area extending from a second end of the 180° fold line, and a C-shaped cut extending between the first and second compressed areas.

2. The blank according to claim 1, wherein the C-shaped cut of each of said two 180° fold lines of the fold-in panels includes a straight cut joining the associated first and second compressed areas of the 180° fold line and first and second end cuts extending transverse to the straight cut at respective ends of the straight cut.

3. The blank according to claim 2, wherein the end cuts are perpendicular to their associated straight cut.

4. The blank according to claim 2, wherein the end cuts extend from their associated straight cut toward the adjacent side edge of the fold-in panel thereof.

5. The blank according to claim 1, wherein each C-shaped cut has the open side of its C-shape facing the adjacent side edge of the fold-in panel thereof.

6. The blank according to claim 1, wherein the second end edge of each fold-in panel includes a notch substantially midway between the first and second side edges of the fold-in panel, and wherein said two 180° fold lines of each fold-in panel extend from spaced locations at the notch.

7. The blank according to claim 6, wherein the notches are trapezoidal shaped, and wherein said two 180° fold lines of each fold-in panel extend from respective corners of the trapezoidal-shaped notch thereof.

8. The blank according to claim 1, further comprising a sealing strip for sealing the blank as a carton.

9. The blank according to claim 1, wherein each compressed area provides a protrusion extending from the surface of the blank opposite the compressed area to define the fold line.

10. The blank according to claim 1, wherein each compressed area is oval in shape.

11. The blank according to claim 1, wherein the blank is corrugated.

12. A carton erected from the blank of claim 1.

13. A blank for producing a carton when joined with a like blank, said blank comprising:

a side panel having substantially parallel first and second end edges and substantially parallel top and bottom edges extending substantially perpendicular to the end edges;

an end panel having first and second side edges substantially parallel with the side panel end edges, and having substantially parallel top and bottom edges, said end panel extending from said side panel with the end panel first side edge joined to the side panel second end edge to define a first 90° fold line and with the end panel top and bottom edges being extensions of the side panel top and bottom edges respectively;

a top panel having first and second side edges substantially parallel with the side panel top edge, and having substantially parallel first and second end edges, said top panel extending from said side panel with the top panel first side edge joined to the side panel top edge to define a second 90° fold line and with the top panel first and second end edges being extensions of the side panel first and second end edges respectively;

a bottom panel having first and second side edges substantially parallel with the side panel bottom edge, and having substantially parallel first and second end edges, said bottom panel extending from said side panel with the bottom panel first side edge joined to the side panel bottom edge to define a third 90° fold line and with the bottom panel first and second end edges being extensions of the side panel first and second end edges respectively;

a first fold-in panel having first and second end edges substantially parallel with the end panel top edge, and having substantially parallel first and second side edges, said first fold-in panel extending from said end panel with the first fold-in panel first end edge joined to the end panel top edge to define a fourth 90° fold line, with the first fold-in panel first and second side edges being extensions of the end panel first and second side edges respectively, and with the first fold-in panel first side edge joined to the top panel second end edge to define a first 180° fold line;

a second fold-in panel having first and second end edges substantially parallel with the end panel bottom edge and substantially parallel first and second side edges, said second fold-in panel extending from said end panel with the second fold-in panel first end edge joined to the end panel bottom edge to define a fifth 90° fold line, with the second fold-in panel first and second side edges being extensions of the end panel first and second side edges respectively, and with the second fold-in panel first side edge joined to the bottom panel second end edge to define a second 180° fold line;

each fold-in panel having two 180° fold lines each extending from a point on the second end edge of such panel substantially midway between the first and second side edges thereof to respective ones of points at the intersections of the first end edge thereof and the first and second side edges thereof, wherein each of said two 180° fold lines of the fold-in panels includes a first compressed area extending from a first end of the 180° fold line, a second compressed area extending from a second end of the 180° fold line, and a C-shaped cut extending between the first and second compressed areas.

14. The blank according to claim 13, wherein the C-shaped cut of each of said two 180° fold lines of the fold-in panels includes a straight cut joining the associated first and second compressed areas of the 180° fold line and first and second end cuts extending transverse to the straight cut at respective ends of the straight cut.

15. The blank according to claim 14, wherein the end cuts are perpendicular to their associated straight cut.

16. The blank according to claim 14, wherein the end cuts extend from their associated straight cut toward the adjacent side edge of the fold-in panel thereof.

17. The blank according to claim 13, wherein each C-shaped cut has the open side of its C-shape facing the adjacent side edge of the fold-in panel thereof.

18. The blank according to claim 13, wherein the second end edge of each fold-in panel includes a notch substantially midway between the first and second side edges of the fold-in panel, and wherein said two 180° fold lines of each fold-in panel extend from spaced locations at the notch.

19. The blank according to claim 18, wherein the notches are trapezoidal shaped, and wherein said two 180° fold lines of each fold-in panel extend from respective corners of the trapezoidal-shaped notch thereof.

20. The blank according to claim 13, further comprising a sealing strip for sealing the blank as a carton.

21. The blank according to claim 13, wherein each compressed area provides a protrusion extending from the surface of the blank opposite the compressed area to define the fold line.

22. The blank according to claim 13, wherein each compressed area is oval in shape.

23. The blank according to claim 13, wherein the blank is corrugated.

24. A carton erected from a pair of the blanks of claim 13.

* * * * *